United States Patent [19]

Baziard et al.

[11] Patent Number: 4,943,453

[45] Date of Patent: Jul. 24, 1990

[54] METHOD AND COLORATION OF PARTS TAKEN AMONG PARTS MADE OF ZINC, COATED WITH ZINC AND MADE OF ZINC CONTAINING ALLOY

[75] Inventors: Yves Baziard, Toulouse; Robert Brun, Bordeaux; Annette P. Duprat, Dax, all of France

[73] Assignee: Societe Civile de Recherche D.B.B., Landes, France

[21] Appl. No.: 198,241

[22] Filed: May 25, 1988

[30] Foreign Application Priority Data

May 25, 1987 [FR] France ..... 87 07346

[51] Int. Cl.[5] ..... B05D 3/04

[52] U.S. Cl. ..... 427/309; 156/664; 8/522; 148/274

[58] Field of Search ..... 8/522; 148/6.1; 427/309; 156/664; 252/79.4, 79.3

[56] References Cited

U.S. PATENT DOCUMENTS 4,200,475 4/1980 Kassbarg ..... 148/6.1
4,238,250 12/1980 Kassbarg ..... 148/6.1

OTHER PUBLICATIONS

Metal Finishing Journal, "*Bright Zinc as a Decorative and Industrial Finish-Part 2*", M. E. Roper, Sep. 1968, pp. 286–294.

Rev. Prog. Coloration, "*The Coloration of Metals*", C. Barnes, 1984, vol. 14, pp. 127–131.

Institute of Metal Finishing, Annual Tech. Conference, "*The Outdoor Performance of Chromium Plate Direct on Zinc*", Barnes, Ward and Carter, May 1981, pp. 154–175.

*Primary Examiner*—Sam Silverberg

*Attorney, Agent, or Firm*—Browdy and Neimark

[57] ABSTRACT

The part is subjected to action of an acid aqueous bath in order to cause the surface of the part to be porous over a thickness which is a fraction of the thickness of the zinc which it includes, and the part is caused to adsorb at least one sealing material.

10 Claims, No Drawings

METHOD AND COLORATION OF PARTS TAKEN AMONG PARTS MADE OF ZINC, COATED WITH ZINC AND MADE OF ZINC CONTAINING ALLOY

BACKGROUND OF THE INVENTION

The present invention relates to a coloration method of metallic surfaces in zinc, or of metals coated with zinc (galvanized, zinc electro-plated parts, etc.) or still of parts made of a zinc containing alloy. The colors which are obtained pertain to the whole visible spectrum.

BRIEF DESCRIPTION OF KNOWN PRIOR ART

Methods for coloration of zinc enabling to obtain several colors, amongst which black and brown are the most current, have been known for a long time. Most of the known techniques are today abandoned since they are not adapted to a profitable industrialization. In fact, according to C. Barnes — The Coloration of Metals, Rev. Prog. Coloration, vol. 14, p. 127 (1984) — the techniques enabling to color a zinc product concern galvanized or zinc electro-plated articles. These coloration methods are in general used so as to increase the zinc corrosion resistance ; therefore, they appear more as anti-corrosion protection techniques, the addition of color being not initially the desired purpose.

It is thus possible to mention variations made from the Cronack - Anderson method, Proc. Am. Electroplater's Soc. Bow, 6 (1943) and Roper, Metal Finishing Journal, 14, No 165, p. 286 (1968) which, by chromatation, enable to form, on the zinc surface a layer which can take according to case, a yellow, green, bronze or black color.

It is also possible to form on the zinc surface a film of a pale blue color, resulting from optical interferences, with a chromatation technique having less anti-corrosive properties than those of the Cronack method. However, this method is adapted only to an identification through color of articles thus treated, since this film has a duration of life which is relatively short.

A method which is well known and used presently in spite of its high cost and toxicity is the method using the black chromatation with silver salts. One begins to consider as preferable methods amongst which the most important is based on the action of trivalent chromium salts — Barnes, Ward and Carter, Inst. Metal Finishing Annual Technical Conference (May 1982) — which color the zinc surface with blue or yellow irisations.

The grey color is obtained by phosphatation.

Finally, the zinc surface can be colored in a greenish black by anodisation in a solution containing hydrofluoric, chromic and phosphoric acids, but this method is only little used due to the high voltages necessary for forming a conversion layer on the surface of the metal.

OBJECT OF THE INVENTION

While none of these surface treatments has simultanously the following advantages:

protection against corrosion,
variety of colors,
ease of putting into practice,
absence of toxicity,
low cost,.

the present invention provides the hereabove advantages.

SUMMARY OF THE INVENTION

According to the invention, the method for coloration of parts made of zinc, coated with zinc and made of a zinc containing alloy, is characterized in that the part is subjected to action of an acid aqueous bath for causing a surface of the part to be porous over a thickness which is a fraction of thickness of the zinc which it includes, and in that the part is caused to adsorb at least one sealing material.

Various other features of the invention will become more apparent from the following detailed description.

DETAILED DISCLOSURE OF THE INVENTION

In the following disclosure, there is indicated that the method relates to coloration of parts made of zinc. It should be clearly understood that these parts can be massive parts in zinc, for example parts manufactured from metal sheets, or parts coated with zinc by any known method, for example by hot galvanization of parts made of another metal, typically parts in ferrous metals, with a thickness of the zinc resulting from the hot galvanization being of about 14 microns.

Parts electro-plated with zinc are included in the same manner within the method of the invention, the thickness of zinc of a zinc electro-plated part being comprised between 5 and 30 microns.

According to the method of the invention, the part made of zinc previously shaped or constituted by a metal sheet intended for being subsequently shaped is subjected to action of a bath constituted of a mixture of acids in solution in water containing also halide ions, and particularly fluoride ions.

It is then advantageous to use acids such as nitric acid and acetic acid. A porous layer of a color slightly greyer than the initial color of the zinc is formed on the surface, setting in evidence the moiré or so-called "flower" effect which is usually presented by zinc. It is also advantageous to use at least one of the salts of these acids (for example : $KNO_3$, $KOOCCH_3$, etc.). The aqueous acid solution can also contain another anion of a nitrogen oxyacid or a peroxide.

By way of example, a satisfactory treatment is provided by preparing, in the first stage of the method, an aqueous solution containing 10% by volume of nitric acid, 5% by volume of acetic acid and 2% by weight of sodium fluoride.

According to a development of the invention, when the part made of zinc has been subjected to the hereabove described acid treatment and then flushed with water, it is transferred, for the second stage of the method, in a coloration aqueous bath or it is subjected to a spraying of a coloration solution.

The coloration aqueous solution contains preferably organic coloring agents such as azo or anthraquinonic coloring agents or phtalocyanine-based coloring agents, these coloring agents being preferred due to their purity and also to the fact that they are very soluble in water.

Although organic coloring agents are preferred, it is nevertheless possible to use certain mineral coloring agents, particularly sodium or ammonium ferric oxalate.

After application of the coloring agent, the part in zinc is subjected, for the third stage of the method, to action of sealing agents adsorbed in the porous layer thus created, and covering such a layer.

These agents are preferably constituted of siccative products or still of synthesis resins, particularly polyurethanes and/or melamines. It is also possible to use as well silicone based sealing products, particularly when the part has to be subsequently subjected to forming operations, particularly by bending and/or stretching.

In order to avoid a deterioration of the coloring agent or agents when these are set in operation, it is advantageous that the parts coming out from the acid bath be flushed with demineralized water, for example by spraying.

Various examples of putting the invention into practice are now described:

EXAMPLE 1

In this example, one has treated a pure zinc sheet of a thickness of 6/10 mm which was only dedusted without being subjected neither to a degreasing nor to a chemical etching.

The sheet has been immersed for 3 minutes in an aqueous bath containing:

10% by volume of 65% nitric acid
5% by volume of 85% acetic acid
20 g/1 of sodium fluoride.

Prior to immersion of the part, the bath has been stirred and maintained at a temperature of 20° C. For duration of the immersion, the stirring was interrupted. The treated sheet was then extracted and flushed with demineralized water sprayed in the form of a mist.

This first stage of treatment has set in evidence the "flower" or moiré of the zinc, the aspect of which presented a slightly more sustained grey color than prior to the treatment.

After drying, melamine in solution in ethylene glycol was sprayed by using a pneumatic gun on the sheet and the sheet was finally put in a stove at 140° C. for 25 minutes.

The grey color which was obtained initially did not suffer any modification during subsequent aging tests, particularly in a wet atmosphere.

EXAMPLE 2

In this example, a hot-galvanized steel sheet was used, the galvanization having a thickness of 14 microns.

The sheet was simply dedusted and dipped in a bath containing :

14% by weight of 65% nitric acid,
5% by weight of 85% acetic acid,
20 g/1 of sodium fluoride.

The immersion lasted 1 minute in the bath set at a temperature of 20° C.

Upon coming out from the bath, the sheet was flushed with demineralized water and, prior to being dry, was then dipped for 5 minutes in a coloration bath constituted by an aqueous solution containing a Green Aluminum LWN azo coloring agent at a concentration of 4 g/1. The temperature of the coloration bath was of 50° C.

After treatment, the sheet was flushed with ordinary water, then dried in the open air.

Melamine in solution in ethylene glycol was then sprayed on the sheet by using an electrostatic gun and the sheet was placed for 25 minutes in a stove heated at a temperature of 140° C. The polymer thus applied on the sheet was colorless.

The green color imparted to the sheet did not suffer variations at end of accelerated ageing tests corresponding to a period of use of 2 years in a wet atmosphere.

EXAMPLE 3

The same operations as those described in Example 2 were put into practice, but the melamine sealing treatment was replaced by an application of a colorless polyurethane resin the polymerization of which was started by a stoving at 80° C. for 30 minutes.

EXAMPLE 4

A mild steel sheet electro-plated with zinc was treated, the sheet having a thickness of 8/10 mm and the thickness of the deposited zinc being of 10 microns.

As in the previous examples, the sheet was only dedusted then dipped in a bath containing:

150 g/1 of potatium nitrate,
5% by weight of 85% acetic acid,
20 g/1 of sodium fluoride.

The immersion lasted 3 minutes in the bath set at a temperature of 20° C. The sheet was then flushed by spraying demineralized water, which put in evidence the zinc "flower" appearing through a porous layer of slightly grey color.

After treatment in the acid bath, the sheet was dipped into an aqueous bath containing a non metallized anthraquinonic coloring agent supplied by the Sandoz Company under designation of Sanodal, the coloring agent concentration in the bath set at a temperature of 45° C. being of 6 g/1.

After drying, the colored sheet was covered with a colorless polyurethane varnish.

The invention is not limited to the embodiments described in detail since various modifications thereof can be carried out thereto without departing from its scope. In particular, polymerization of the synthesis resins constituting the sealing product can, in a known manner, be started and/or accelerated by action of an ultraviolet, infrared, high frequency or micro-wave radiation.

We claim:

1. A method for coloration of parts taken among parts made of zinc, coated with zinc and made of zinc containing alloy, comprising the steps of subjecting each of said parts to action of an acid aqueous solution containing halogen ions, nitric acid and acetic acid for causing surface of the part to be porous over a layer of a thickness of zinc of the part, flushing the part, and causing the part to absorb at least one sealing material.

2. The method as set forth in claim 1, wherein the porous layer is caused to absorb at least one coloring agent prior to absorption of the at least one sealing material.

3. The method as set forth in claim 1, wherein the acid aqueous solution, has a temperature which is close to room temperature.

4. The method as set forth in claim 2, wherein the step of absorbing at least one coloring agent is made by using a coloring aqueous solution containing the at least one coloring agent and which is at a temperature between room temperature and 60° C.

5. The method as set forth in claim 2, wherein the at least one coloring agent is a water-soluble coloring agent.

6. The method as set forth in claim 2, wherein the at least one coloring agent is an organic coloring agent selected from the group consisting of azo, anthraquinonic and phtalocyanine based coloring agents.

7. The method as set forth in claim 2, wherein the at least one coloring agent is a mineral coloring agent selected from the group consisting of sodium and ammonium ferric oxalates.

8. The method as set forth in claim 2, wherein absorption with said at least one coloring aqueous solution is effected by a step taken among dipping the parts in the solutions and spraying the solutions on the parts.

9. The method as set forth in claim 1, wherein the acid aqueous solution has an acid concentration and a treatment duration which are chosen so as to provide a porous layer the thickness of which is of the order of a micron.

10. A method according to claim 2 wherein the porous layer is caused to absorb at least one coloring agent after a flushing step and before said sealing.

* * * * *

UNITED STATES PATENT AND TRADEMARK OFFICE

CERTIFICATE OF CORRECTION

PATENT NO. : 4,943,453

DATED : July 24, 1990

INVENTOR(S) : BAZIARD et al.

It is certified that error appears in the above-identified patent and that said Letters Patent is hereby corrected as shown below:

On the title page and Col 1, line 1-5:

[54] Delete "METHOD AND COLORATION", insert therefor -- METHOD FOR COLORATION --

Signed and Sealed this

Eighth Day of June, 1993

Michael K. Kirk

MICHAEL K. KIRK

*Acting Commissioner of Patents and Trademarks*

*Attest:*

*Attesting Officer*